US006571955B1

(12) United States Patent
Rossman

(10) Patent No.: US 6,571,955 B1
(45) Date of Patent: Jun. 3, 2003

(54) BEAD HOLDER

(76) Inventor: Terri Rossman, 28200 Westbrook Ct., Farmington Hills, MI (US) 48334

( * ) Notice: Subject to any disclaimer, the term of this patent is extended or adjusted under 35 U.S.C. 154(b) by 0 days.

(21) Appl. No.: 09/827,724

(22) Filed: Apr. 6, 2001

Related U.S. Application Data

(60) Provisional application No. 60/214,678, filed on Jun. 27, 2000.

(51) Int. Cl.[7] ..... B65D 85/00

(52) U.S. Cl. ..... 206/575; 206/538; 206/540

(58) Field of Search ..... 206/223, 526, 206/528, 534, 538, 540, 575, 562, 563; 211/74; 422/104, 916

(56) References Cited

U.S. PATENT DOCUMENTS

| | | | | | |
|---|---|---|---|---|---|
| 611,136 | A | | 9/1898 | Mason | |
| 2,774,466 | A | | 12/1956 | Liska | 206/42 |
| 3,602,371 | A | * | 8/1971 | Weiner et al. | 211/74 |
| 3,797,648 | A | * | 3/1974 | Shaw | 206/446 |
| 4,022,318 | A | * | 5/1977 | Goodman | 206/223 |
| 4,068,798 | A | * | 1/1978 | Rohde | 211/74 |
| 4,124,122 | A | * | 11/1978 | Emmitt | 422/104 |
| 4,396,121 | A | | 8/1983 | Lemmon | 206/566 |
| 4,453,636 | A | * | 6/1984 | Meadows et al. | 206/534 |
| 4,453,639 | A | * | 6/1984 | Sharma | 211/74 |
| 4,510,119 | A | * | 4/1985 | Hevey | 211/74 |
| 4,593,819 | A | | 6/1986 | Will | 206/538 |
| 4,693,371 | A | | 9/1987 | Malpass | 206/538 |
| 4,826,003 | A | * | 5/1989 | Levy | 206/223 |
| 5,027,966 | A | * | 7/1991 | Yadock | 220/230 |
| 5,046,609 | A | * | 9/1991 | Mangini et al. | 206/534 |
| 5,159,581 | A | * | 10/1992 | Agans | 206/538 |
| 5,344,024 | A | * | 9/1994 | Cohu | 206/526 |
| 5,636,743 | A | | 6/1997 | Dalbo | 206/564 |

* cited by examiner

*Primary Examiner*—Jim Foster
(74) *Attorney, Agent, or Firm*—Young & Basile, P.C.

(57) ABSTRACT

A bead holder provides storage of a plurality of beads and having individual tubular containers therein for separation and containment of like kind beads. The bead holder includes multiple rectangular boxes, each rectangular box has a clasp closure and store in an upright orientation and a plurality of individual tubular containers with plastic stopper closures. The bead holder is made of a transparent plastic material to allow visual access of all the assortment of beads within each tubular container.

17 Claims, 2 Drawing Sheets

BEAD HOLDER

The application claims priority of provisional patent application 60/214,678 filed on Jun. 27, 2000.

FIELD OF THE INVENTION

This invention relates to a system of containers for small craft items such as beads or the like which compartmentalizes similar craft items together and provides visual access to all of the craft items within each of the compartments.

BACKGROUND

People who work with beads either as a hobby or in their profession may accumulate hundreds of different designs and types of beads which vary by color and size as well as material. Until now, it has been difficult to easily store the multitude of types of beads such that they are all visually accessible and easily retrievable to the person during use, as well as providing containers that are stackable and easily transportable.

In the prior art as disclosed in U.S. Pat. No. 5,636,743 ('743) issued to Dalbo, a bead tray is disclosed wherein individual compartments lay adjacent to each other within a tray formation. A pair of individual compartments butt up to each other at their end walls so that the front walls of each compartment are adjacent to the peripheral wall of the tray. A funnel opening from each compartment has an aperture through the peripheral wall of the tray for retrieval of the beads. In order to visually distinguish each of the types of beads contained in each compartment of the prior art, a single tray must be unlayered to expose and view the different beads stored therein. The bead storage tray disclosed in U.S. Patent '743 would necessarily require an extremely long length to view dozens of different beads at one time. This configuration would not provide for easy storage and transport of the beads. In addition, to remove a particular type of bead from its compartment, the entire tray must be tilted on an angle to allow the bead to flow through the funnel. If the tray is long in order to contain many dozens of types of beads, tilting the tray to retrieve a particular bead would be cumbersome. Therefore, it is desirable to provide a bead holder which allows a person to easily transport and visually distinguish more than a hundred different types and colors of beads at one time.

SUMMARY

The present invention addresses the aforementioned concerns by providing a bead holder for storage of a plurality of beads and for the separation of like kinds of beads having an open frame with a sleeve formation and a solid top surface with through front and rear openings. The frame slidably receives a drawer therein. The drawer has an open-ended top providing access to the interior of the drawer. The interior of the drawer has a predetermined width and length for receiving a plurality of outer cases therein. Each outer case has a width corresponding with the interior width of the drawer. Each outer case is capable of receiving storage tubes having removable plastic plug closures. A plurality of storage tubes are capable of placement and storage within each outer case.

Another aspect of the invention provides that the frame, drawer, outer case and storage tubes are made from a clear plastic material to provide visual access to a multitude of beads stored therein.

In another aspect of the invention, the sleeve formation of the frame is open along five sides having reinforced edges and corners to outline the frame, and a solid plastic top surface to prevent the outer cases being inadvertently dislodged from the drawer when the drawer is within the frame.

In yet a further aspect of the invention, the parallel lower edges of the frame have a rail guide formed along an inner surface of the lower edge. The drawer has a bottom surface having a pair of rails positioned to align with the rail guide on the frame to provide easy slidable movement of the drawer within the frame.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
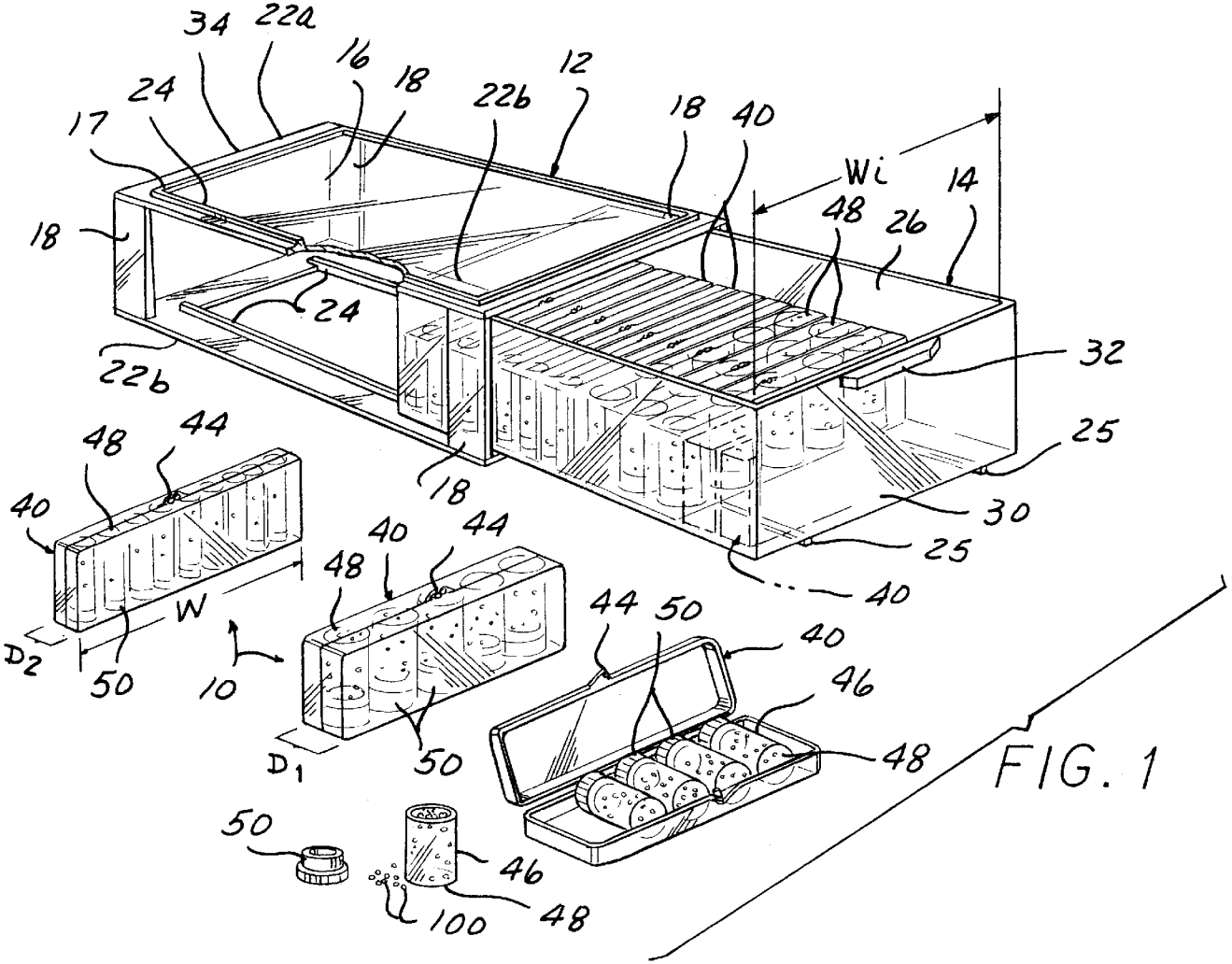
FIG. 1 is a perspective view of the bead holder in accordance with the present invention within a container assembly including a frame and drawer in an open position and three bead holders removed from the drawer.
Figure 2:
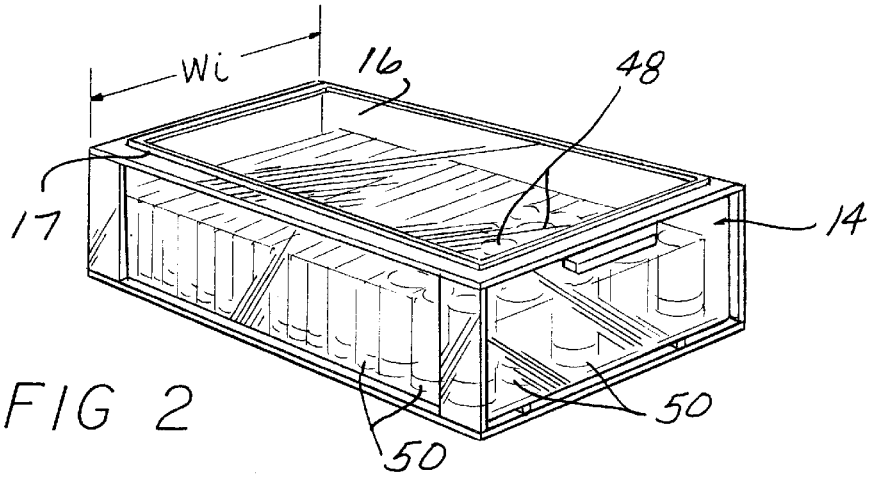
FIG. 2 is a perspective view of the container assembly showing the drawer in a closed position having multiple bead holders therein.

Referring now to the drawings, the bead holder 10 of the present invention provides an outer case 40 in which multiple plastic storage tubes 46 can be stored. Individual bead holders 10 may be transported in a purse or pocket of the user. Multiple bead holders 10 may be transported in available boxes such as shoe boxes or in a frame and drawer assembly as described hereinafter.

Each outer cases 40 has a predetermined width (W) which is slightly smaller than a typical shoe box (not shown). The depth or thickness (D1 and D2) of the outer case 40 can vary to accommodate different sizes of storage tubes 46 therein. The outer cases 40 are made of a clear plastic having a clasp opening 44. The outer cases 40 can be placed in a shoe box or in the drawer 14 through an open-ended top 26. The outer cases 40 enclose plastic storage tubes 46 having cylindrical sides with a permanently closed first end 48 and a removable plastic plug style closure 50 at the opposing end.

Figure 3A:
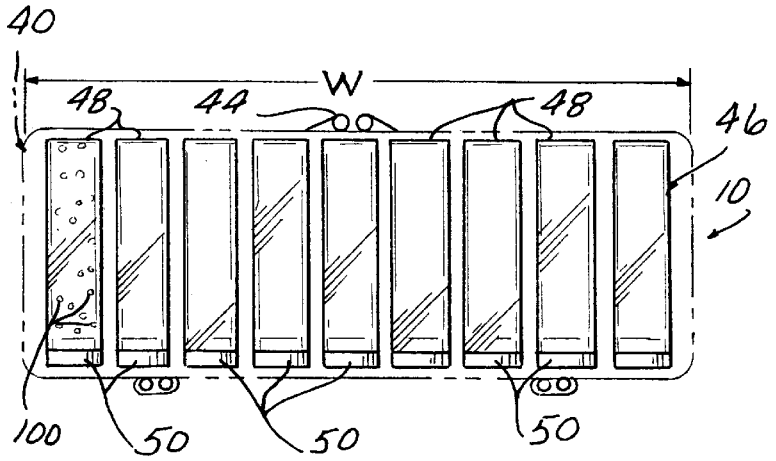
FIG. 3*a* is a side elevational view of one embodiment of a bead holder including an outer case containing storage tubes therein.
Figure 3B:
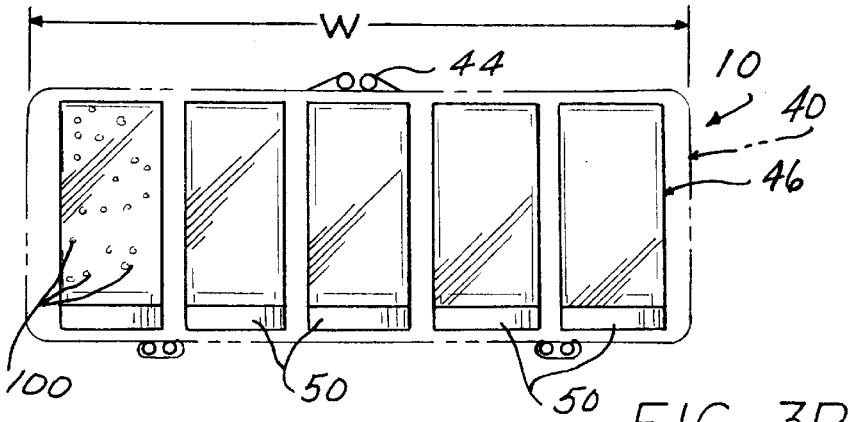
FIG. 3*b* is the side elevational view of another embodiment of a bead holder including a plastic outer case containing storage tubes of a different size therein.

In the preferred embodiment the plastic storage tubes 46 are provided in various sizes. The illustrated embodiment shows tubes 46 having dimensions 2" H×⅝" diameter (FIG. 3*a*). Other plastic storage tubes are shown having dimensions of 2" H×1⅛" diameter (FIG. 3*b*). The outer boxes 40 have a depth (D1 and D2) to receive one of the sizes of tubes. The width (W) and depth (D1 or D2) of the outer boxes 40 are such that when filled with the appropriate storage tubes 46 will allow little lateral movement of tubes 46. Therefore, tubes 46 of the same size are placed in a particular outer case 40 sized for the same sized tubes so that the tubes 46 remain upright relative to the outer box 40. Each storage tube 46 will accommodate a particular style, color or size bead in one storage tube 46. This will keep similar beads in the same tube for easy retrieval. A person using the bead container assembly of the present invention will divide his or her beads into the desired categories and then place each category of beads in its individual tube 46. The plastic plug-style closure 50 seals the beads within the tube 46. The outer case 40 can accommodate multiple tubes 46 in an upright position as shown in FIGS. 3*a* and 3*b*. The outer cases 40 are preferably placed in a shoe box or in the drawer 14 such that the plastic plug-style closure 50 is facing the bottom of the drawer 14. Therefore, when the drawer 14 is placed into the frame 12, the contents of each tube 46 is clearly visible through the clear plastic top surface 16 of the frame.

The two-piece frame 12 and drawer assembly 14 is configured and adapted to hold a plurality of bead holders 10. The two piece frame 12 and drawer assembly is sized to be the approximate dimensions of a typical shoe box. These dimensions provide easy, stackable containers that are not bulky and are easily transportable. The frame or shell 12 has a sleeve formation for receiving the drawer 14 therein. Although the frame 12 could include a five sided structure having only one open wall for entry of the drawer 14, to save in material cost it is only necessary to provide a clear or transparent plastic top surface 16 and reinforced corners 18 and edges 22*a, b* along the other four sides. The clear plastic top surface 16 prevents the outer cases 40 from falling out of the drawer 14 when the bead holder system is in a closed position. The top surface 16 may include a ridge 17 extending around and adjacent to the periphery of the top surface 16 so that the top surface 16 may be used as a working surface for arrangement of the beads 100. The ridge 17 will maintain the beads 100 on the top surface 16. The bottom support edges 22*b* of the frame 12 will preferably include a rail guide 24 on the inside surfaces to guide the movement of the drawer 14 therein.

The drawer 14 is a five walled box having an open-ended top 26. The drawer 14 is sized to fit snugly within the frame 12 and also to accommodate outer cases 40 having various depth sizes therein. Along the outside surface of the floor of the drawer 14 are a pair of corresponding rails 25 for alignment with the rail guide 24 in the frame 12 and facilitate the movement of the drawer 14 in the frame 12. The forward wall 30 of the drawer 14 has a handle 32 attached thereon. In the preferred embodiment, the handle 32 is positioned at the upper edge of the forward wall 30. In the illustrated embodiment the handle 32 extends slightly above the upper edge of the forward wall 30 so that the handle 32 acts as a stop for the drawer 14 and prevents the drawer 14 from sliding through the back side 34 of the frame 12. A stop may also be provided by a stop ridge (not shown) at the far end of the rail guide 24, or by a reinforced corner 18 extending into the back side 34 of the frame 12, or by the forward wall 30 of the drawer 14 extending above the top surface of the frame 12. The drawer 14 is capable of holding a plurality of outer boxes 40.

The use of clear plastic throughout the assembly for individual tubes, outer cases and two-piece drawer system allows for easy visual access to the beads. If a particular bead is required, then only the particular outer case 40 holding that bead will need to be dislodged from the drawer 14 and then only the individual tube will need to be retrieved from the outer case 40 and tilted to retrieve the bead 100. The bead holder 10 of the present invention also helps to keep track of the supply of a particular style of bead so that a person can quickly observe whether a reorder of the bead is necessary. The bead holder 10 also allows for easier transport of possibly over a hundred types of beads within a typical shoe box or in the single frame and drawer assembly. The frame and drawer assembly also allows for stackable storage of the beads on shelves. The lower edges 22*b* of the frame 12 may include a corresponding ridge (not shown) which stacks within or around the ridge 17 on the top surface 16 of the frame 40 to facilitate the stacking of the bead container assemblies.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law. For example, one modification could include a pair of outer cases 40 having smaller widths then previously discussed; but when placed side-by-side adjacent to each other could have a total width of (W) for placement into drawer 14 so that there is little lateral movement of the pair of outer cases 40.

What is claimed is:

1. A bead holder for storage of a plurality of beads and for separation of like kind beads comprising:

reusable storage tubes for receiving beads therein, each storage tube having longitudinal peripheral sides and two ends spaced from each other by the longitudinal peripheral sides and a removable plastic plug closure at one of the ends; and an outer case having an interior with predetermined dimensions for receiving the storage tubes such that when the interior of the outer case is filled with a predetermined number of the storage tubes, the storage tubes in the outer case are aligned in linear formation such that adjacent storage tubes in the outer case contact each other along the longitudinal peripheral sides and little lateral movement of the storage tubes in the outer case is allowed, the outer case having a hinged configuration with a clasp closure for securing the storage tubes therein.

2. The bead holder of claim 1 wherein the storage tubes are cylindrical and made of clear plastic.

3. The bead holder of claim 2, wherein the outer case is made of clear plastic.

4. The bead holder of claim 3, wherein the storage tubes are sized so that the storage tubes remain upright relative to the outer case when the predetermined number of the storage tubes fill the outer case.

5. A bead holder for storage of a plurality of beads and for separation of the kind beads comprising:

storage tubes having removable plastic plug closures for receiving beads therein, wherein each of said storage tubes are made of clear plastic;

an outer case having predetermined dimensions for receiving the storage tubes such that when the outer case is filled with a predetermined number of the storage tubes, little lateral movement of the storage tubes in the outer case is allowed, said outer case made of clear plastic and each of the storage tubes sized so that the storage tubes remain upright relative to the outer case; and a frame and drawer assembly, wherein the outer case has a width adapted for placement within the frame and drawer assembly.

6. The bead holder of claim 5, wherein frame and drawer assembly includes a frame having a sleeve formation with a solid top surface and through front and rear opening and drawer slidably receivable into the frame.

7. The bead holder of claim 6, wherein the drawer has an open-ended top providing access to the interior of the drawer, and said interior of the drawer has a predetermined width and length for receiving at least two outer cases.

8. The bead holder of claim 5, wherein the storage tubes are cylindrical.

9. A bead container assembly for storage of a plurality of beads and for the separation of like kind beads comprising:

an open frame having a sleeve formation with a solid top surface and a through front and rear opening;

a drawer slidably receivable into said frame and having an open-ended top providing access to the interior of the drawer, said interior of the drawer having a predetermined width and length for receiving at east two outer cases, each outer case having a width corresponding with the interior width of the drawer; and storage tubes having removable plastic plug closures for receiving beads therein, said storage tubes sized for placement in the outer cases.

10. The bead container assembly of claim 9, wherein the frame, drawer, outer case, and storage tubes are made from a clear plastic material.

11. The bead container assembly of claim 10, wherein the frame includes reinforced edges and corners.

12. The bead container assembly of claim 11, wherein reinforced edges include a pair of parallel lower edges, each parallel lower edge has a rail guide formed along an inner surface of said lower edge.

13. The bead container assembly of claim 12, wherein the drawer has a bottom surface and said bottom surface has a pair of rails positioned to align with the rail guide on the frame.

14. The bead container assembly of claim 11, further including a stop means for preventing the drawer from sliding through the rear face.

15. The bead container assembly of claim 14, wherein the drawer has a front wall, a rear wall, and a pair of side walls.

16. The bead container assembly of claim 9, wherein more than one outer case when placed adjacent to each other in a side-by-side formation have a width corresponding to the interior width of the drawer.

17. A bead holder in combination with beads, comprising a plurality of transparent storage tubes having plug closures; beads disposed in said tubes; and a transparent outer case enclosing an interior having substantially undivided storage space substantially filled with a linear formation of the tubes.

* * * * *